US006131528A

United States Patent [19]

Meek et al.

[11] Patent Number: 6,131,528

[45] Date of Patent: Oct. 17, 2000

[54] DOCKING APPARATUS

[75] Inventors: Michael Kilpatrick Meek, 9/28 Rudd Road Street, Broadbeach, Queensland 4218; David Alexander McKean; Craig Thomas Marriot, both of Ashmore, all of Australia

[73] Assignee: Michael Kilpatrick Meek, Australia

[21] Appl. No.: 08/981,713

[22] PCT Filed: Jun. 24, 1996

[86] PCT No.: PCT/AU96/00376

§ 371 Date: Aug. 10, 1998

§ 102(e) Date: Aug. 10, 1998

[87] PCT Pub. No.: WO97/00807

PCT Pub. Date: Jan. 9, 1997

[51] Int. Cl.[7] ..... B63C 1/02

[52] U.S. Cl. ..... 114/44

[58] Field of Search ..... 114/44, 48, 49, 114/50, 52, 53

[56] References Cited

U.S. PATENT DOCUMENTS

| | | | |
|---|---|---|---|
| 4,732,102 | 3/1988 | Holman et al. | 114/48 |
| 4,934,298 | 6/1990 | Pritchett | 114/44 |

FOREIGN PATENT DOCUMENTS

| | | | |
|---|---|---|---|
| 2280544 | 2/1976 | France | 114/44 |

*Primary Examiner*—Jesus D. Sotelo
*Attorney, Agent, or Firm*—BakerBotts, L.L.P.

[57] ABSTRACT

A docking apparatus includes a pair of spaced apart primary buoyancy bodies and cradle assemblies extending between the bodies, the primary buoyancy bodies being capable of being filled with water and thus submerged, to enable a water craft to be positioned over the cradle assemblies and lifted clear of the water when water is expelled from the bodies. The cradles include flexible sheets of a V-shaped configuration which adjust to the shape of the water craft seating thereon to enable the docking apparatus to be used with a range of hulls of different forms.

23 Claims, 4 Drawing Sheets

DOCKING APPARATUS

TECHNICAL FIELD

This invention relates to docking apparatus of the type which are capable of lifting marine craft above the surrounding water level for storage or other purposes for example for maintenance or repair purposes.

BACKGROUND ART

A number of different designs of docking apparatus which lift water craft above the surrounding water level are currently available. Docking apparatus of this type normally comprises a pair of spaced apart bodies which can contain air so that the bodies may float and support a water craft above the water level but which may be filled or partially filled with water to sink the bodies to enable the water craft to be launched or to enable a water craft to be located over the apparatus for subsequent lifting. A major disadvantage of the known apparatus is that they are generally rigid structures and therefore usually only suitable for lifting water craft having a hull design which matches the structure unless a series of adjustments are made. Thus docking apparatus of this type, to overcome the above disadvantage, has to be manufactured to suit the particular water craft with which it is to be used.

The present invention aims to overcome or alleviate the above disadvantages or at least provide an alternative to known docking apparatus by providing apparatus which is capable of lifting water craft above the water for storage or other purposes which will adjust to suit a range of water craft of different hull configurations.

SUMMARY OF THE INVENTION

The present invention thus provides docking apparatus including:

cradle means for elevating a watercraft above the water;

laterally spaced apart elongate buoyancy chambers supporting said cradle means, said buoyancy chambers by themselves being able to support the cradle means and the watercraft in the elevated position;

flooding means for submerging the buoyancy chambers;

discharging means for discharging water from the flooded chambers;

a buoyant body attached to each buoyancy chamber for providing the docking apparatus with positive buoyancy when the buoyancy chambers are submerged.

The cradle means may be in the form of at least one resiliently deformable support member which is fixed at opposite ends to the respective buoyancy chambers but which will flex when subject to a load thereon to conform to the shape of the underside of the hull of the water craft.

Typically the at least one support member may be in the form of a semi-stiff sheet or strap extending between the buoyancy chambers. The sheet or strap preferably extends downwardly and inwardly from its opposite ends. The sheet or strap may have a substantially V-shaped configuration to receive the V-shaped hull of the water craft. The sheet or strap is preferably of a material which flexes when subject to the weight of the water craft, whereby the sheet or the strap substantially conforms to the underside of the water craft when supported thereon.

The support members may extend from pedestal members mounted on each said buoyancy chamber. The pedestal members may incline inwardly of said buoyancy chambers. The support members preferably extend from the upper surface of the pedestal members and substantially at right angles to the axis of the pedestal members.

Preferably the buoyancy chambers are joined together by one or more transverse spacing members. The one or more transverse spacing members are joined to a lower portion of each of the buoyance chambers. Preferably the buoyancy chambers are hingedly connected to said buoyancy chambers. The hinge connections provides pivotal movement of said buoyancy chambers about respective longitudinal axes.

Alternatively, the hinged movement may be achieved by live or integral hinges at or adjacent the connection between the transverse spacing members and buoyancy chambers. The hinge connection may also provide for a degree of pivotal movement of the buoyancy chambers about a vertical axis so that the chambers which are normally substantially parallel to each other may adopt other than a substantially parallel attitude, again to match the water craft hull in the fore and aft direction.

Preferably the sheet or strap of the support member is formed of a semi rigid non-corrosive sheet material which is flexible enough to flex when subject to the weight of the water craft. A particularly suitable material is a stiff plastics, for example high density polyethylene. Other plastics, however, may be suitable for this purpose. The buoyancy chambers may also be constructed of a similar material. The buoyancy chambers are preferably rigid. The buoyancy chambers are preferably widely spaced apart. The buoyancy chambers may be disposed adjacent the lateral extremities of the docking apparatus.

The buoyancy chambers may comprise two or more chambers incorporating one or more compartments within each chamber. Such chambers may float or be submerged due to the interchange of air and water within those compartments by way of an air pumping and exhaust system. When air is forced into the buoyancy chambers, water is discharged from the chambers through exhaust openings suitably provided in the underside of the chambers such that buoyancy and consequently lift is achieved. When air is released from the buoyancy chambers, water may enter through the underside exhaust openings to allow the buoyancy chambers to submerge.

The flooding means includes the exhaust openings through which water passes into and out of the buoyance chambers during flooding and discharge. The exhaust openings may be connected to tubes which may be lowered so as to be in communication with the water in which the chambers are located or raised above the water level. The tubes may be substantially rigid tubes which are connected through a pivot connection to each chamber whereby they may be pivotally raised or lowered.

The discharging means includes air valves through which air is pumped into the buoyancy chambers for discharging water therefrom.

The buoyant bodies remain buoyant and support the apparatus when the buoyancy chambers are submerged, thereby limiting the depth below the water surface of the support member. For this purpose, the buoyant bodies comprise sealed bodies of one or more compartments. The buoyant bodies may be of elongated form and extend fixedly substantially parallel to the buoyancy chambers. The buoyant bodies are normally substantially smaller in diameter than the buoyancy chambers.

The buoyant bodies are supported on substantially vertical struts mounted on said buoyancy chambers at the lateral extremities thereof.

For releasing air from the buoyancy chambers, air valves may be connected to each buoyancy chamber, whereby when the valves are open, air is capable of being exhausted therefrom. Alternatively for this purpose, a single valve may be connected to each buoyancy chamber such that operation of the valve may simultaneously connect those chambers to atmosphere.

When the tubes are lowered and the valve or valves are opened, the buoyancy chambers will fill with water through the tubes to submerge the buoyancy chambers. When the tubes are raised above water level, opening of the valve or valves will not result in the buoyancy chambers submerging.

For elevating the docking apparatus and the water craft supported thereon, air is pumped into the buoyancy chambers through the aforementioned valves to cause water in the chambers to be discharged through the tubes.

BRIEF DESCRIPTION OF THE DRAWINGS

In order that the invention may be more readily understood and put into practical effect, reference will now be made to the accompanying drawings which illustrate a preferred embodiment of the invention and wherein.

DETAILED DESCRIPTION OF THE INVENTION

Figure 1:
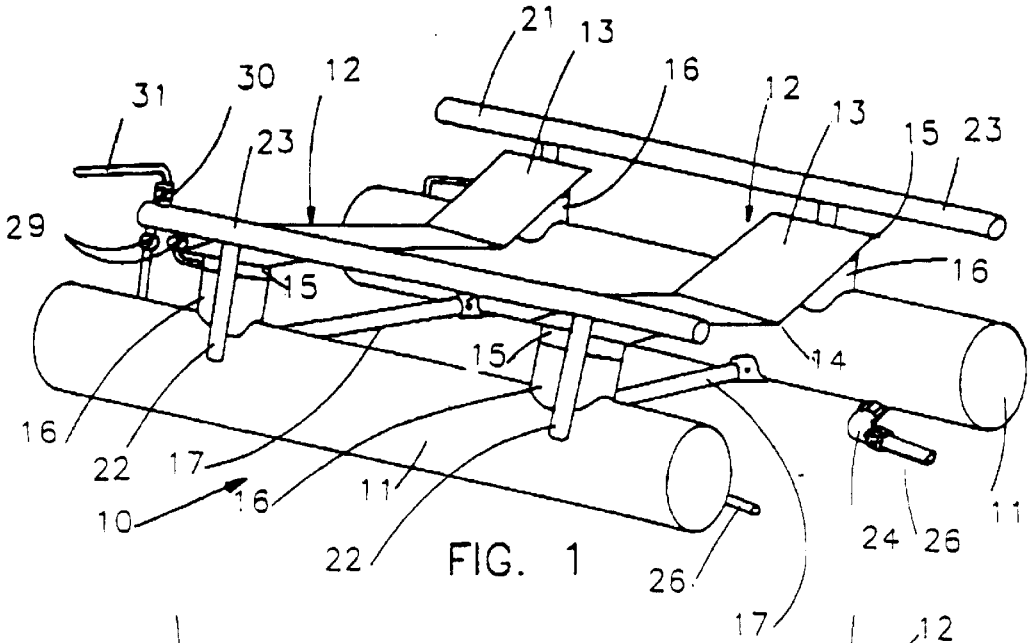
FIG. 1 is a perspective view from the rear of docking apparatus according to the present invention.
Figure 2:
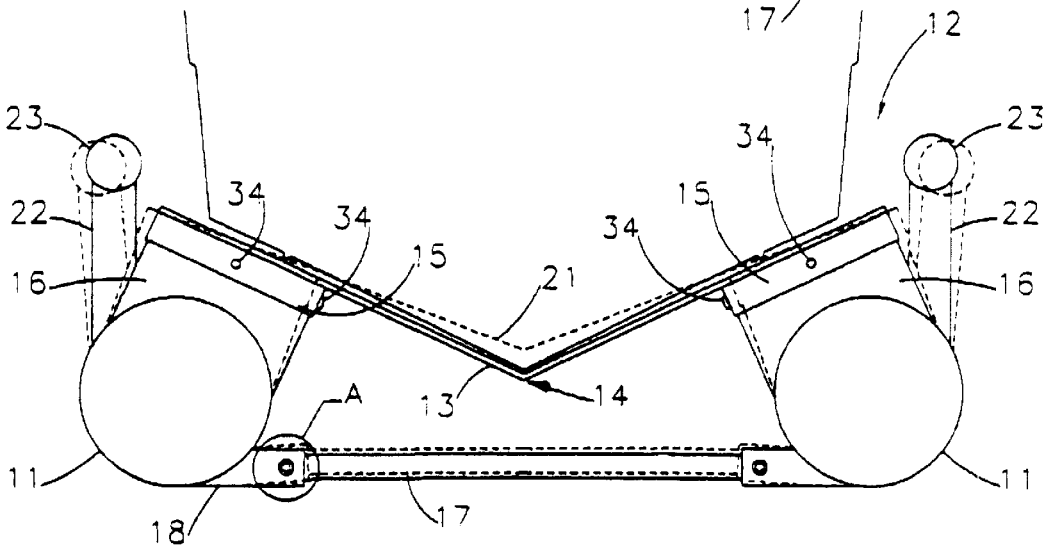
FIG. 2 is a rear view of the apparatus of FIG. 1.
Figure 2A:
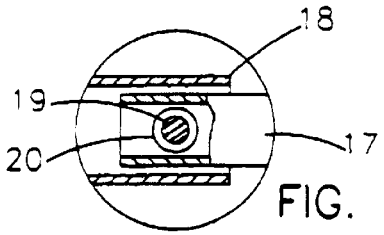
FIG. 2A is an enlarged sectional view of the region designated A in FIG. 2.
Figure 3:
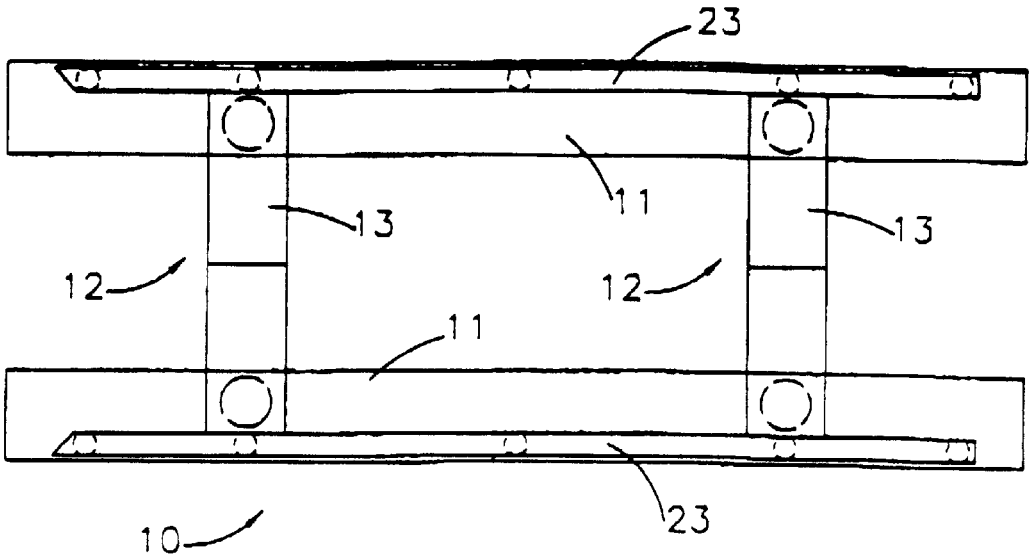
FIG. 3 is a plan view of the docking apparatus of FIG. 1.
Figure 4:
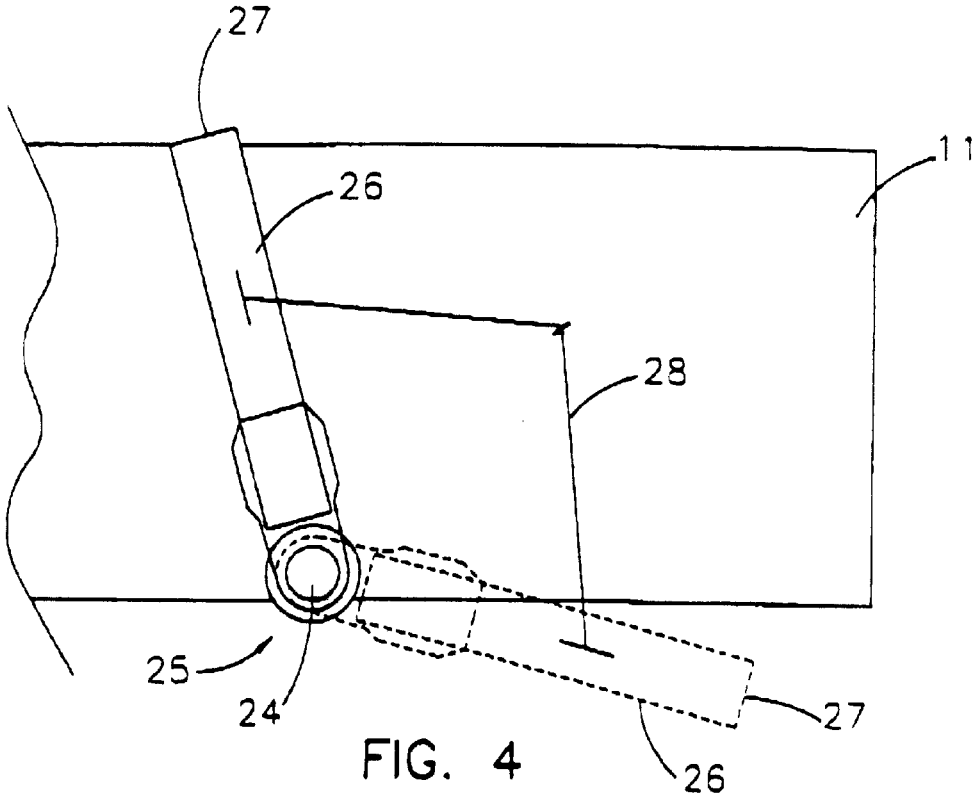
FIG. 4 illustrates a typical exhaust duct of the apparatus.

Referring to the drawings and firstly to FIG. 1 to 3, there is illustrated docking apparatus 10 according to the present invention, comprising a pair of elongated spaced apart substantially tubular primary buoyancy bodies 11. Extending between the bodies 11 are a pair of cradles 12, each of which includes a sheet 13 which is of a V-shaped configuration about a valley 14 arranged centrally of the bodies 11. The sheets 13, at each end, are provided with downwardly extending tubular sockets or skirts 15 which are adapted to locate over, in a telescopic fashion, upwardly directed hollow spigots 16 which extend from the buoyancy bodies 11, the spigots 16 being inclined inwardly towards each other.

The bodies 11 are also joined on their lower side by one or more transversely extending members 17 which in this embodiment are of tubular form. A member 17 extends at each end into tubular sockets 18 which are fixed to a lower side of the buoyancy bodies 11 and extend somewhat tangentially therefrom and towards each other. The tubular sockets 18 are of a larger diameter than the diameter of the member 17 such that the member 17 is free for some movement in the sockets 18. Pivot pins 19 extend transversely through each socket 18 and through openings 20 in an end of the member 17 located therein to form a pivot connection allowing hinged movements of the bodies 11 about substantially horizontal axes towards and away from each other. The pivot pins 19 are a relatively loose fit in the ends of the members 17 being smaller than the diameter of the openings 20.

Hinged movement of the bodies 11 is accompanied by deformation of the sheet 13 providing a sharper or shallower V configuration to match the hull 21 of a water craft supported thereon as shown in FIG. 2. The V-shaped cradles 12 can thus conform to the shape of the hull 20 without any need for external adjustments.

Mounted above the bodies 11 via supports 22 are secondary buoyancy bodies 23 which are of tubular form and which extend longitudinally of and substantially parallel to each body 11. The bodies 23 are sealed and limit the depth to which the apparatus 10 is submerged when the primary bodies 11 are flooded.

Exhaust openings 24 are provided on the lower side of each body 11 and are connected through a hollow pivot joint 25 to exhaust tubes 26. The tubes 26 are thus capable of being pivoted between a lower position illustrated in dotted outline where the end 27 of a tube 26 is submerged and a raised position where the end 27 of the tube 26 is above the water level. Movement of the tubes 26 between these positions may be simply achieved by means of suitable manual means such as a boat pole to push the tube 26 downwardly and a rope or cable 28 connected to the tubes 26 which enables the tubes 26 to be pulled upwardly to the raised position.

In an alternative simplified arrangement, the exhaust openings 24 do not have the extending tubes 26 but are open all the time. A disadvantage of this arrangement however is that if an air leakage occurs in one of the bodies 11, water will fill that body 11 through the opening 24 and thus tipping the apparatus 10 to a possible unstable attitude.

Air valves for raising and lowering of the apparatus may be mounted on the apparatus 10 or adjacent thereto, such as on a jetty or pontoon. In one form, the air valves comprise a pair of manually actuable valves 29 connected to the respective primary buoyancy bodies 11 and to a common main air valve 30. The valves 29 and 30, as shown in FIG. 1 may be mounted on one of the secondary buoyancy bodies 23. This arrangement allows the user to select whether both bodies can receive air or release air simultaneously by opening both valves 29 and the main valve 30 or whether one valve 29 should be opened earlier than the other valve 29, for example to exhaust one body 11 of water to level the apparatus 10 in the event that excess weight is on one side. The valve 30 is connectable to a source of air, for example from a compressor, through an air supply line 31.

Figure 5:
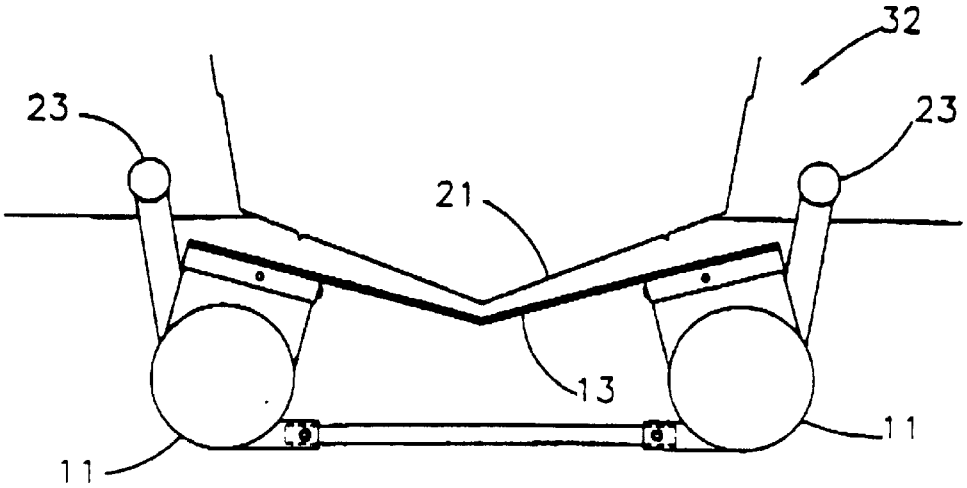
FIGS. 5 to 7 illustrate schematically the operation of the apparatus of the invention.
Figure 6:
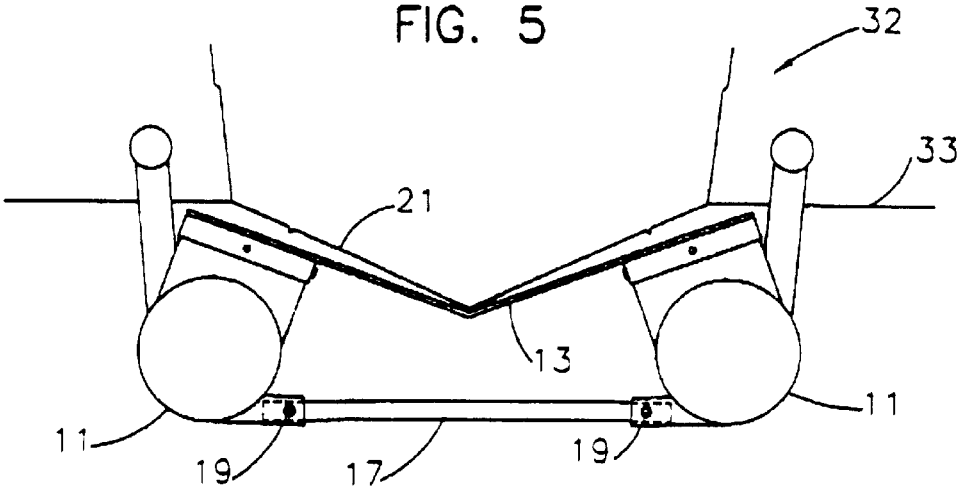
Figure 7:
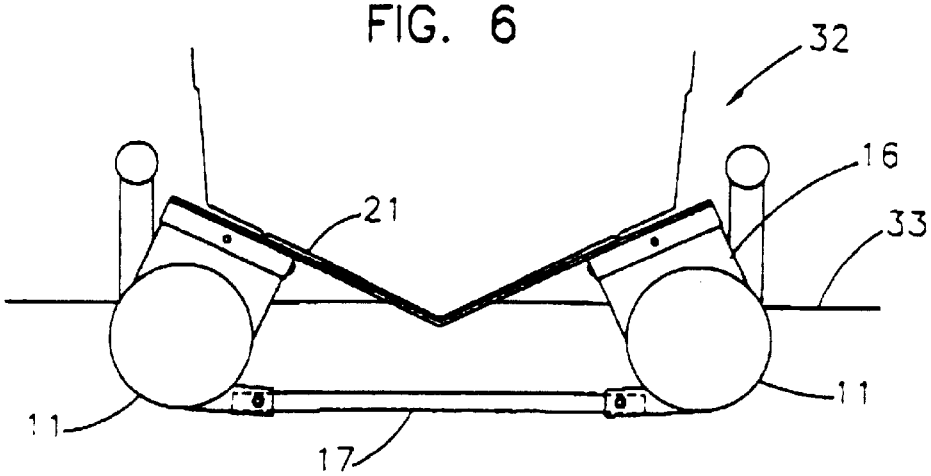

In use and as shown in FIGS. 5 to 7, where it is desired to lift a water craft 32 having a V-shaped hull 21 from the water, the apparatus 10 is lowered by lowering the tubes 26 and opening the bodies 11 to the atmosphere through the valves 29 and 30. This will permit water to fill both the bodies 11 through the tubes 26 and exhaust openings 24 to submerge the bodies 11 to a level where the secondary buoyancy bodies 23 are at or adjacent the water level 33 and supporting the bodies 11.

The craft 32 is then moved over the apparatus 10 and cradles 12 and then air forced into the bodies 11 via the line 31 and valves 30 and 29 to expel water therefrom. This will increase the buoyancy of the bodies 11 causing the apparatus 10 to rise. In this movement, the keel of the water craft 32 will locate initially in the valley 14. Further elevating of the apparatus 10 will cause the sheets 13 to flex and conform to the underside shape of the hull 21 of the water craft 32 as shown in FIG. 6 and 7. To allow this to occur the bodies 11 will move in a hinge like fashion toward each other about the pivot pins 19, whilst being restrained from moving outwardly by the members 17. Further or continued application of air to the bodies 11 will cause the bodies 11 to elevate the water craft 32 clear of the water level 33 with the hull 21 nesting within the sheets 13 and being supported at the chines by the spigots 16. Lowering of the water craft 32 into the water is the reverse of the above procedure.

The docking apparatus illustrated in FIG. 1 and 2 is shown to have two cradles 12. It may however incorporate more than two cradles or only a single cradle and a further means for example a fixed cradle to support the remainder of the hull. In yet an alternative configuration the sheet like cradle 12 may be extended to support the full length of the water craft hull 21.

As stated above, the sheets 13 are provided with spaced apart sockets or skirts 15 of tubular form which are capable of being located over the upstanding spigots 16 on the main buoyancy bodies 11. To hold the skirts 15 in position, bolts or screws 34 may be located in spaced apart circumferential positions around the skirt 15 to secure the skirt 15 to the spigots 16. Removal of the bolts 34 allows the skirts 15 to be detached from the spigots 16. Similarly, the pivot pins or bolts 19 can be removed to enable detachment of the transverse members 17. This allows the apparatus 10 to be disassembled into a convenient form for transport and reassembly as required. All the components of the apparatus 10 are preferably formed of a plastics material such as polyethylene and permanent joins formed by plastics welding.

Figure 8:
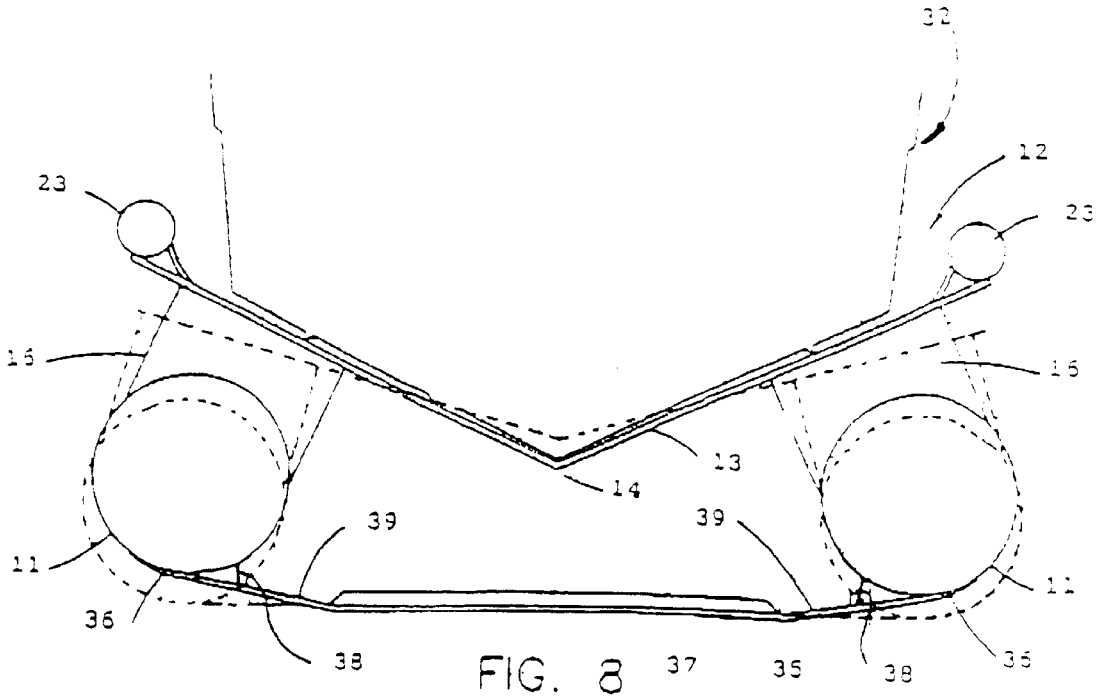
FIG. 8 is a rear view of an alternative form of apparatus according to the invention.

In an alternative arrangement shown in FIG. 8, in which like components have been given like numerals, the transverse members 17 are replaced by a planar sheet or sheets 35, similar to the sheet 13 and joined to each body 11 at 36 by adhesives or welding. The sheet 35 is braced by an upstanding member 37 which terminates short of the bodies and at the bodies 11 by further braces 38. The braced sheet 35 provides a relatively rigid support between the bodies 11 on their underside but permits some pivotal or hinged movement of the bodies 11 about the regions 39 which act as integral hinges, the regions 39 comprising regions of the sheet 35 which are unsupported. This is shown in dotted outline in FIG. 8 where the position of the bodies 11 prior to the supporting of the water craft 32 is shown.

Whilst the above has been given by way of illustrative embodiment of the invention, all such modifications and variations thereto was would be apparent to persons skilled in the art are deemed to fall within the broad scope and ambit of the invention as herein defined in the appended claims.

We claim:

1. A docking apparatus comprising:

cradle means for elevating a watercraft above the water;

laterally spaced apart elongate buoyancy chambers supporting said cradle means, said buoyancy chambers by themselves being able to support the cradle means and the watercraft in the elevated position;

flooding means for submerging the buoyancy chambers;

discharging means for discharging water from flooded chambers; and a buoyant body attached to each buoyancy chamber for providing the docking apparatus with positive buoyancy when the buoyancy chambers are submerged, wherein said cradle means includes at least one resiliently deformable support member fixed at opposite ends to the respective buoyancy chambers and adapted to conform to an underside of the watercraft.

2. The docking apparatus according to claim 1, wherein said cradle means includes a plurality of resiliently deformable support members fixed at opposite ends to the respective buoyancy chambers.

3. The docking apparatus according to claim 1, wherein said cradle means includes a plurality of deformable support members fixed at opposite ends to the respective buoyancy chambers, wherein each of said support members is in the form of a semi-stiff strap extending between the buoyancy chambers.

4. The docking apparatus according to claim 1, wherein said cradle means includes a plurality of resiliently deformable support members fixed at opposite ends to the respective buoyancy chambers, wherein each of said plurality of support members is in the form of a semi-stiff strap extending between the buoyancy chambers and extending downwardly and inwardly from its opposite ends.

5. The docking apparatus according to claim 1, wherein said cradle means includes a plurality of resiliently deformable support members fixed at opposite ends to the respective buoyancy chambers, wherein each of said plurality of support members extend from pedestal members mounted on each said buoyancy chamber.

6. The docking apparatus according to claim 1, wherein said cradle means includes a plurality of resiliently deformable support members fixed at opposite ends to the respective buoyancy chambers, wherein each of said plurality of support members extends from a pedestal member mounted on each said buoyancy chamber and incline inwardly of said buoyancy chambers.

7. The docking apparatus according to claim 1, wherein said cradle means includes a plurality of resiliently deformable support members fixed at opposite ends to the respective buoyancy chambers, wherein each of said plurality of support members extends from an upper surface of a pedestal member mounted on said buoyancy chamber.

8. The docking apparatus according to claim 1 and including at least one transverse spacing member attached to said buoyancy chambers.

9. The docking apparatus according to claim 1, and including a plurality of transverse spacing members attached to a lower portion of each of the buoyancy chambers.

10. The docking apparatus according to claim 1, and including a plurality of spacing members hingedly connected to said buoyancy chambers.

11. The docking apparatus according to claim 1, and including a plurality of transverse spacing members hingedly connected to said buoyancy chambers, wherein hinge connections provide pivotal movement of said buoyancy chambers about respective longitudinal axes.

12. The docking apparatus according to claim 1, wherein said buoyancy chambers are rigid.

13. The docking apparatus according to claim 1, wherein said buoyancy chambers are rigid, said buoyancy chambers and said cradle means being formed of stiff plastics material.

14. The docking apparatus according to claim 1, wherein said buoyancy chambers are rigid, said buoyancy chambers and said cradle means being formed of stiff plastics material comprised of high density polyethylene.

15. The docking apparatus according to claim 1, wherein the buoyancy chambers are widely spaced apart.

16. The docking apparatus according to claim 1, wherein the buoyancy chambers are widely spaced apart and are disposed adjacent the lateral extremities of the docking apparatus.

17. The docking apparatus according to claim 1, wherein the flooding means includes exhaust openings through which water passes into and out of the buoyancy chambers during flooding and discharge.

18. The docking apparatus according to claim 1, wherein the flooding means includes exhaust openings through which water passes into and out of the buoyancy chambers during flooding and discharge, said exhaust openings being connected to tubes which may be lowered so as to be in communication with the water in which the chambers are located or raised above the water level.

19. The docking apparatus according to claim 1, wherein the flooding means includes exhaust openings through which water passes into and out of the buoyancy chambers during flooding and discharge, said exhaust openings being connected to tubes which may be lowered so as to be in communication with the water in which the chambers are located or raised above the water level, said tubes being substantially rigid tubes which are connected through a pivot connection to each chamber whereby said tubes may be pivotally raised or lowered.

20. The docking apparatus according to claim 1, wherein the discharging means includes air valves through which air is pumped into the buoyancy chambers for discharging water therefrom.

21. The docking apparatus according to claim 1, wherein the buoyant bodies are of elongated form and are mounted to the respective buoyancy chambers and extend substantially parallel to the buoyancy chambers.

22. The docking apparatus according to claim 1, wherein the buoyant bodies are supported on substantially vertical struts mounted on said buoyancy chambers at the lateral extremities thereof.

23. The docking apparatus according to claim 1 wherein the cradle means includes a plurality of resiliently deformable support members which extend from pedestal members mounted on said buoyancy chambers, said buoyancy chambers being spaced apart by a hinged connection to at least one transverse spacing member, said buoyancy chambers being thereby able to rotate about their longitudinal axis, facilitating conformation of said plurality of support members to the underside of the watercraft.

* * * * *